US006361427B1

(12) United States Patent
Sjoberg

(10) Patent No.: US 6,361,427 B1
(45) Date of Patent: Mar. 26, 2002

(54) DRIVE ARRANGEMENT FOR AN EXTRACTING DEVICE, ESPECIALLY FOR EXHAUST GASES FROM MOTOR VEHICLES

(75) Inventor: Krister Sjoberg, Lycksele (SE)

(73) Assignee: Plymovent AB, Lycksele (SE)

( * ) Notice: Subject to any disclaimer, the term of this patent is extended or adjusted under 35 U.S.C. 154(b) by 0 days.

(21) Appl. No.: 09/807,022

(22) PCT Filed: Oct. 7, 1999

(86) PCT No.: PCT/SE99/01796

§ 371 Date: May 24, 2001

§ 102(e) Date: May 24, 2001

(87) PCT Pub. No.: WO00/20139

PCT Pub. Date: Apr. 13, 2000

(30) Foreign Application Priority Data

Oct. 7, 1998 (SE) ..... 9803427

(51) Int. Cl.[7] ..... B08B 15/02
(52) U.S. Cl. ..... 454/64
(58) Field of Search ..... 454/63, 64; 60/315; 285/9.1, 62, 1

(56) References Cited

U.S. PATENT DOCUMENTS 4,086,847 A * 5/1978 Overmyer ..... 454/63
4,660,465 A * 4/1987 Jentzsch et al. ..... 454/63
4,724,751 A * 2/1988 Jentzsch et al. ..... 454/64
5,085,133 A * 2/1992 Hickling et al. ..... 454/63
5,679,072 A 10/1997 Brodin
5,749,779 A * 5/1998 Wilburn et al. ..... 454/65
6,139,422 A * 10/2000 Blaschke ..... 454/63

FOREIGN PATENT DOCUMENTS

| | | |
|---|---|---|
| EP | 0 895 817 | 2/1999 |
| WO | WO 95/29771 | 11/1995 |
| WO | WO 97/30801 | 8/1997 |

* cited by examiner

*Primary Examiner*—Harold Joyce
*Assistant Examiner*—Derek S. Boles
(74) *Attorney, Agent, or Firm*—Young & Thompson

(57) ABSTRACT

The present invention relates to an extracting system for exhaust gases from motor vehicles (5), which is provided with a winch (16) for the transportation of a carriage (2) along an extraction channel (1) and the winding up of a hose (14) to a rest position. The winch has only one line (24) which is arranged to run freely through the extraction channel and through control means (26, 28) and coupling means (35)in the carriage. By this means it is possible to hoist up the hose (14) with the use of just one line for the winding and to secure the hose in its rest position and move the carriage (2) from an end position (6) to a start position (4) by means of said line.

14 Claims, 4 Drawing Sheets

Figure 1:
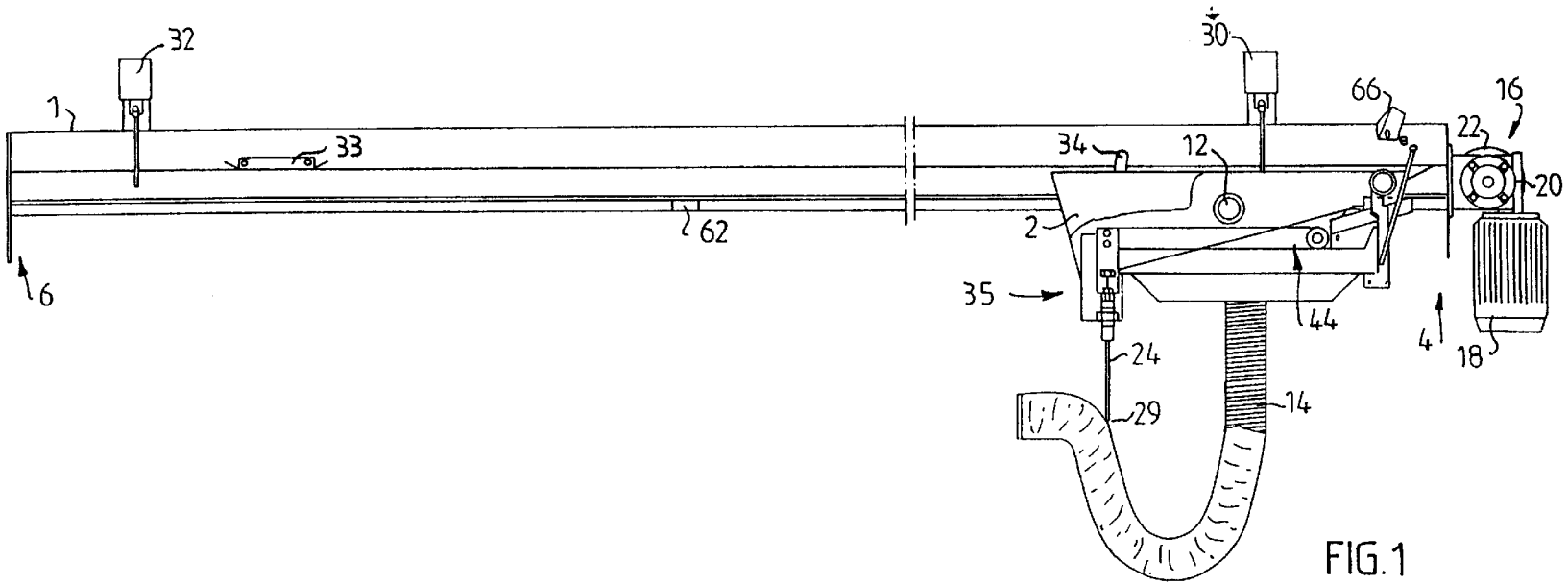

DRIVE ARRANGEMENT FOR AN EXTRACTING DEVICE, ESPECIALLY FOR EXHAUST GASES FROM MOTOR VEHICLES

The present invention relates to an extractor system, especially for exhaust gases from a motor vehicle, comprising an extractor channel with a carriage, which is arranged to connect the extractor channel to a hose and which is guided along the extractor channel and drawn by the vehicle from a start position to an end position, which hose can be connected to the exhaust pipe of the vehicle and can be detached therefrom at the end position, where the carriage can be retained by means of a catch device, which can be released by a drive device, which is additionally arranged to manoeuvre the hose to a rest position in connection with the carriage, which, with the catch device released, can be returned to the start position via a flexible element connected to the drive device.

Extractor systems of this type are well known in industry and are generally used in assembly plants, vehicle inspection centres and the like for sucking out and collecting exhaust gases, especially from vehicles as they are moved from one end of the premises to another. In a known extractor system of this type, which is described in Swedish Patent 9600624-2, with the same Applicant as the present patent application, the drive device comprises an endless flexible element which, via pulley wheels, is arranged to run freely through the carriage and in two directions between the start position and end position of the carriage. A drive member can be joined to the endless element by means of a coupling member in order to drive the element. The hose can be drawn up to its rest position via a separate cable, and a drum supported by the carriage and used for winding up the cable has members for driving the drum by means of the endless element. At the end position, a catch member is provided for the carriage and is arranged to release the latter when the hose is in its rest position, at the same time as the drum, via the member for rotating it, is locked by means of a catch mechanism actuated by the cable, as a result of which the endless element brings the carriage to the start position.

Although the known extractor system has a single drive source for driving the endless element, a separate lifting cable with a special drive mechanism is needed for the hose. The carriage is therefore provided with the rotatable drum for winding up the lifting cable, and a pair of pulley wheels for driving the drum in rotation by means of the endless element, which for this purpose runs round the pair of pulley wheels. The endless element must extend through an adjusting device, with which the distance between some of the pulley wheels can be varied.

It is therefore relatively difficult to install and adapt this system, for example when changing the lifting cable or endless element, and poor routing of the latter can lead to the element coming out of engagement with the pulley wheels. This solution therefore entails quite substantial costs, both for installation and for maintenance.

It is an object of the invention, therefore, to provide an extractor system, of the type set out in the introduction, in a simpler and more reliable way than before, which system comprises a common drive device for moving the carriage and for drawing the hose up to a rest position. This is made possible by the fact that the drive device has a which located at the start position for winding up the element, which extends through recesses in the carriage to an attachment point on a predetermined part of the hose, which via the element can be drawn up to the rest position and can be anchored to the carriage by means of a coupling device acting on the catch device.

Developments and refinements as well as additional features and advantages of the invention will be evident from the dependent patent claims and from the following description.

An embodiment of the invention is described below only by way of example, and with reference to the attached diagrammatic drawings.

Figure 2:
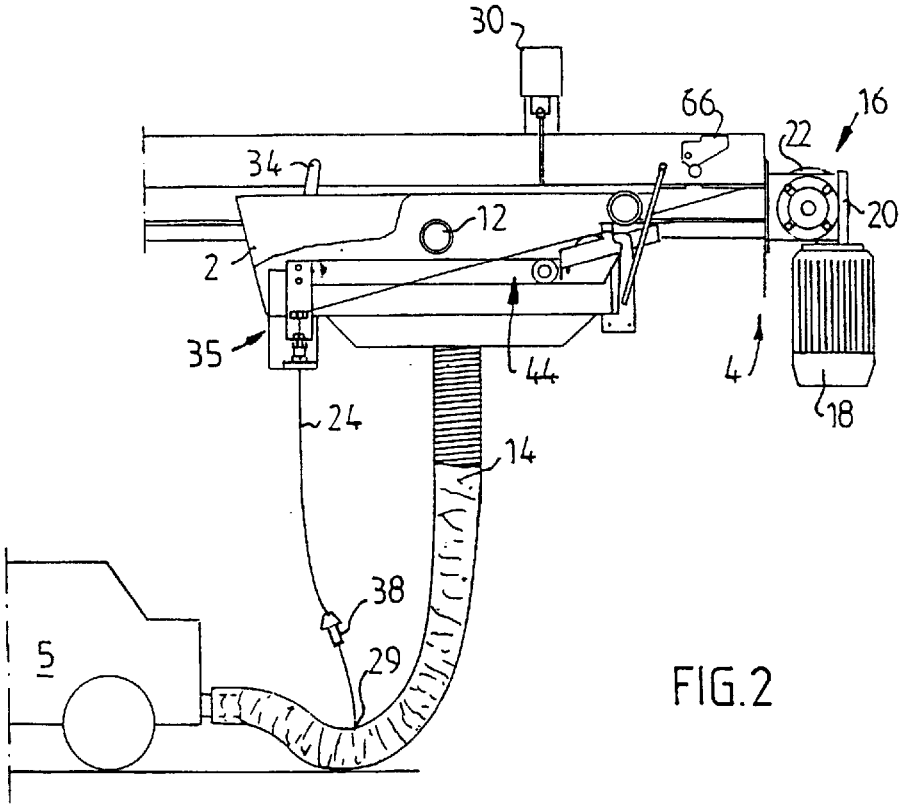
Figure 3:
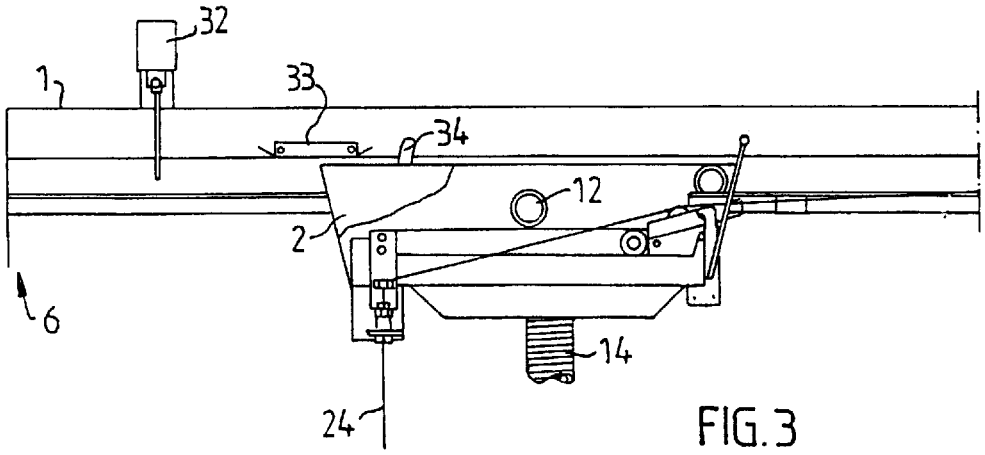
Figure 4:
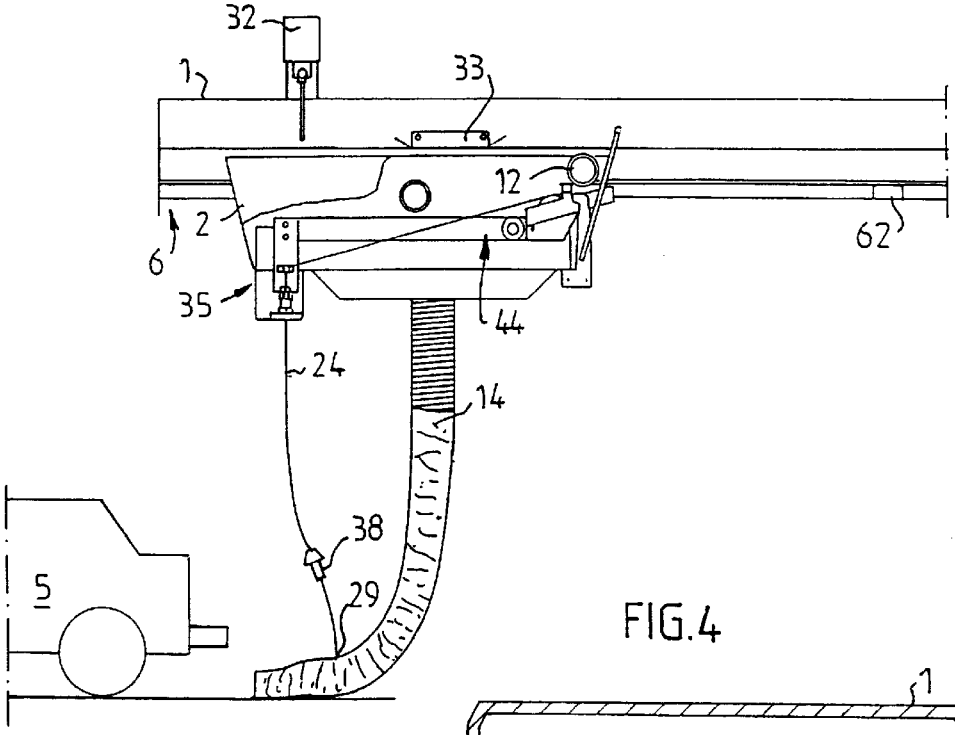
Figure 5:
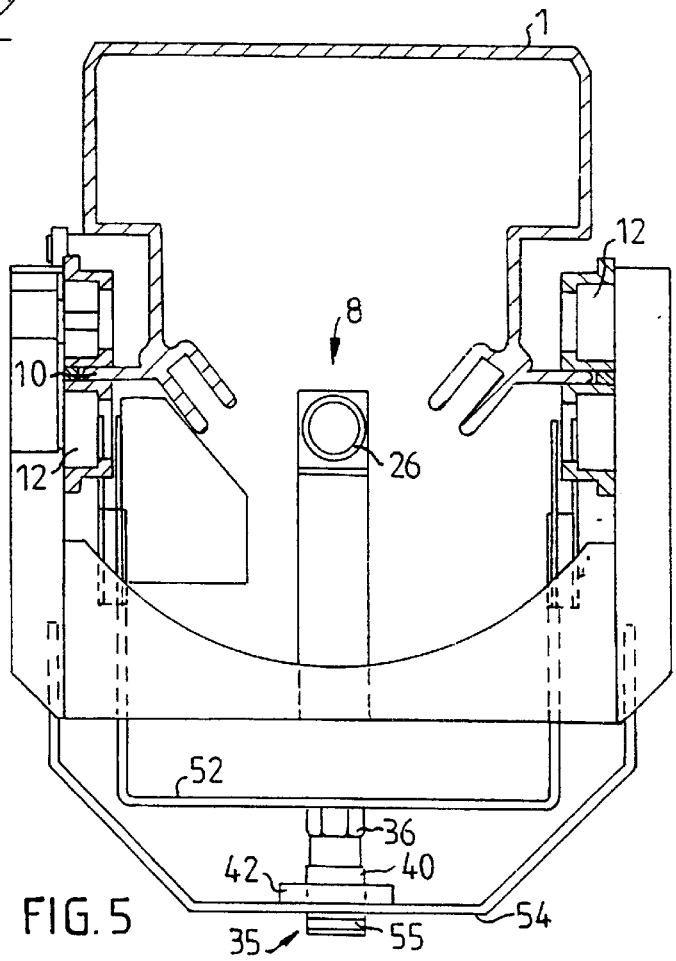
Figure 6:
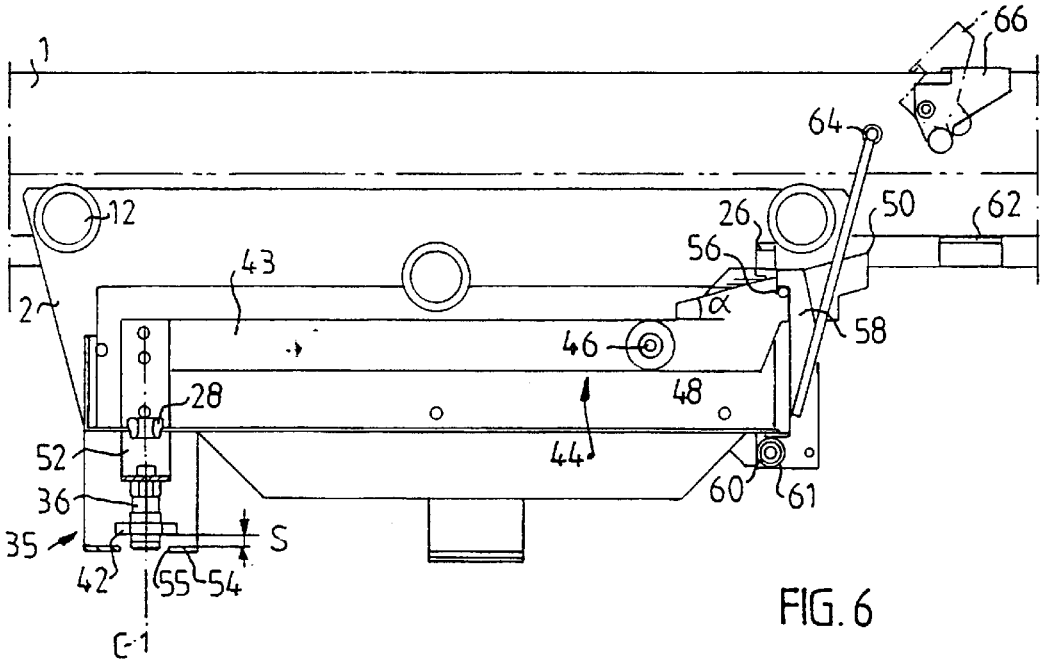
Figure 7:
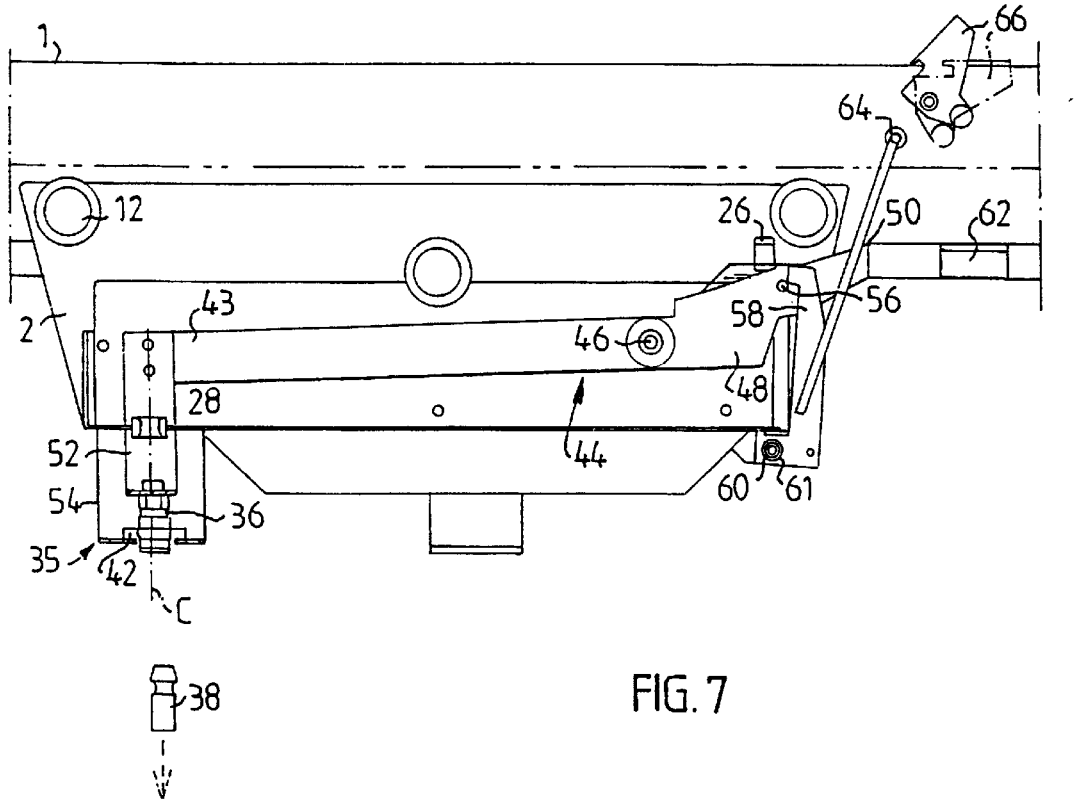

FIG. 1 shows a side view of an extractor system with a drive device according to the present invention, with a partially cut-away carriage in the start position, and with the hose anchored in its rest position, FIG. 2 shows a side view of part of the extractor system according to FIG. 1, with the hose connected to the exhaust pipe of a vehicle, and with the carriage about to leave the start position, FIG. 3 shows part of the extractor system according to FIG. 1, when the carriage is approaching the end position, FIG. 4 shows a view similar to FIG. 3, when the carriage is in the end position, FIG. 5 shows a cross section through an extractor channel included in the system according to the invention, provided with a partially cut-away carriage, and FIGS. 6 and 7 show more detailed side views of the carriage with a lever arm mechanism for its releasable coupling device for anchoring the hose in the rest position, and a catch device for the carriage in the end position.

In the extractor system shown in FIG. 1, reference number 1 generally designates an essentially horizontally extending extractor channel, with a carriage 2 which is guided along the latter and which is intended to run freely from a start position 4 and drawn by a vehicle 5 or the like to an end position 6 along the extractor channel. Those characteristics of the extractor channel and of the carriage for carrying off the exhaust gases have already been described in detail in Swedish Patent 9600624-2, for which reason these are not described in detail herein. However, as will be evident from FIG. 5, the extractor channel is provided in a known manner with a slot 8 arranged on the underside with sealing tongues (not shown). The extractor channel is also profiled with projections 10 which are arranged as support and guide rails for a number of wheels 12 mounted on the carriage, so that the carriage can travel along the extractor channel. To save space, the channel is preferably profiled with an inwardly drawn cross section provided with the said projections adjoining the slot, which projections consist of a rail which is located on each side of the extractor channel and which, on both sides, is under the effect of the carriage wheels 12.

FIGS. 1 and 2 show an illustrative embodiment of the parts of the extractor system which are essential for driving the carriage 2 and pulling up the hose 14. In the start position 4, the extractor channel 1 is provided with a winch 16 having an electric motor 18 with an electromagnetic coupling which is coupled to a gear 20 whose output shaft is connected to a drum 22. In FIG. 1, a flexible element 24, for example in the form of a cable or the like, is wound up in a conventional manner on the drum 22 and is arranged to run through the carriage. The cable runs through recesses or cable passages provided in the carriage, in the form of first 26 and second 28 guide members, to an attachment point 29 on a predetermined part of the hose 14. The length of wound-up cable must be such that the carriage, drawn by the vehicle 5 via the hose 14, can take up its end position without being impeded by the run of the cable 24. This is facilitated by the fact that, by means of the electromagnetic coupling of the electric motor 18, the drum 22 is arranged to run freely so that the cable is unwound from the drum.

The electric motor 18 is controlled by first 30 and second 32 limit switches which are arranged at the start position 4 and end position 6, respectively. Each limit switch can, in the present case, be connected to the electric motor 18 via an adjustable delay circuit (not shown) of a conventional type, in order to act on the winch 16 with a time delay from the point at which an impulse has been emitted from the respective limit switch 30, 32. It is thus possible, by simple means, to adjust the running of the carriage in accordance with requirements. The carriage is provided with a coupling device 35 for securing or releasing the hose 14. The hose 14 is connected sealingly to the vehicle exhaust pipe in a known manner via a coupling member (not shown) driven by compressed air. To ensure that the hose 14 will come loose from the vehicle exhaust pipe when the carriage 2, drawn by the vehicle 5, approaches the end position 6, the extractor channel is provided in a known manner with a cam 33 or similar member which, acting on a valve 34, controls the air pressure to t he coupling member.

The first and second guide members 26, 28 are mounted securely in the frame of the carriage 2 and are each designed, for example, as an annular cable passage made of suitable material with low friction, for example plastic.

The coupling device 35 is designed as a releasable snap lock in accordance with the principle of a conventional hydraulic coupling or hose coupling and, like these, has two parts which can be joined together, namely a female part or coupling sleeve 36, and a male part or coupling means 38.

The coupling sleeve 36 has, in a conventional manner, locking members (not shown) which, when the coupling means 38 is introduced into the sleeve, spring aside in order thereafter to come into locking engagement with a lock part in the coupling device. The locking engagement can be released by means of a release muff 40 which is arranged on the coupling sleeve 36, can be axially displaced in the direction a way from the coupling device 38 counter to a spring force, and has a diametrically projecting flange 42. Both the coupling sleeve and the coupling device have a continuous concentric channel (not shown) through which the cable 24 can run. The coupling means 38 is secured to the cable 24, near the attachment point 29 on the hose 14, in a suitable manner, for example by means of a plastic plug or the like (not shown). The coupling sleeve 36 is mounted securely on the free end of a first lever arm 43 belonging to a two-arm lever arm mechanism 44 which is articulated on the carriage 2 and is mounted so as to pivot about a pivot axle 46 and has a second lever arm 48 whose free end is designed as a catch member 50 which, on that side of the lever arm mechanism directed away from the coupling sleeve 36, forms an angle $\alpha$ with the continuation of the first lever arm 43. Together with a stop shoulder 62 connected to the extractor channel 1, the catch member 50 forms a catch device which, depending on the position of the lever arm mechanism, acts on the movement of the carriage along the extractor channel. The distances between the pivot axle 46 and the end of the first lever arm 43, and the end of the second lever arm 48, are designated by a and b, respectively. Tests have shown that the angle $\alpha$ should be chosen within a range of 10 to 20° and the ratio between a and b should be $\geqq 2$, for reasons which will be described later. The sleeve 36 is advantageously mounted on the end of the first lever arm 43 via a spacing member 52, and the lever arm mechanism 44 is suspended from the carriage 2 in such a way that the sleeve 36 is coaxial with and situated outside the guide member 28 mounted securely in the frame of the carriage 2.

A decoupling member 54 is securely anchored to the outside of the carriage 2 and is provided with a recess 55 through which the release muff 40 can project with adequate clearance. This makes it possible, by swinging the lever arm mechanism 44, for the flange 42 of the sleeve to come to bear against that part of the decoupling member 54 adjoining the recess 55. The sleeve is thus movable essentially along a centre axis c between two limit positions which comprise the guide member 28 on the one hand and the decoupling member 54 on the other.

The second lever arm 48 with the catch member 50 is provided with a locking element 56 which is located such that a locking hook 58, which is directed towards the locking element in the carriage 2 and can be pivotably suspended about a pivot pin 60 in the same, is pressed by means of the force of a spring 61 against and comes into engagement with the locking element 56 when the flange 42 on the release muff 40 of the coupling device 35 is located at a predetermined distance s in mm from the decoupling member 54. The distance s can be adjusted by means of the fact that the decoupling member 54 is secured in the frame of the carriage 2 by screws (not shown) through oblong holes (also not shown). When the locking hook 58 is in engagement with the locking element 56, the distance s should be at least so great that no part of the flange 42 bears against that part of the decoupling member adjoining the recess 55. Suitable values for the distance s are therefore in the range of 3 to 5 mm.

In the state illustrated in FIG. 6, the coupling device 35 is in its locking position, i.e. the coupling means 38 can be introduced into the coupling sleeve 36 for locking engagement with the latter. In addition, the catch member 50 is fixed via the locking element 56 and the locking hook 58 in such a position that the carriage 2 can pass the stop shoulder 62 without the catch member 50 being braked by the latter. The locking hook 58 is provided with a projecting release arm 64 arranged to cooperate with a manoeuvring rocker 66 which is mounted so as to pivot in the start position 4 of the extractor channel and which is so configured that it avoids the release arm 64 when the carriage moves towards the start position 4 (see FIG. 1) but catches the release arm when the carriage moves away from the start position 4 (see, FIG. 2). As will be seen from FIG. 7, the locking hook 58 is in the latter case carried by the release arm 64 caught by means of the rocker 66 and is pivoted about the pivot pin 60, counter to the force of the spring 61, away from engagement with the locking element 56. The above-described geometry of the lever arm mechanism 44 then ensures that the second lever arm 48 can pivot upwards, as seen in the drawing, under the effect of the gravity on the first lever arm 43 with the spacing member 52 and the coupling sleeve 36. The catch member 50 in this position comes into contact with the stop shoulder 62 which stops the carriage 2 if an attempt is made to return the latter from the end position 6, u until the lever arm mechanism 44 is switched to the position shown in FIG. 6.

However, since the catch member 50 forms the angle $\alpha$ with the first lever arm 43, the carriage 2 can pass the stop shoulder 62 in the opposite direction. Thus, in the position shown in FIG. 7, the flange 42 of the coupling sleeve 36 has been pressed against the decoupling member 54 under the effect of the gravity of the first lever arm added to the weight of the hose 14 via the cable 24 and the coupling means 38. In this way, the release muff 40 has been displaced in the direction towards the spacing member 52, in which position the catch members (not shown) release the coupling means 38 from the coupling sleeve 36.

The extractor system functions in the following way. The carriage 2 is parked (FIG. 1) in its start position, in which the hose 14 is anchored in its rest position via the cable 24 and the coupling device 35. When the carriage was returned to the start position 4 by means of the winch 16 and the cable 24, the first limit switch 30 was activated by the carriage frame and cut out the winch motor 18, and the manoeuvring rocker 66 was switched by the release arm 64 without entraining the latter. To connect the hose 14 to the motor vehicle 5 (FIG. 2), the carriage is moved a short distance horizontally by hand, in such a way that the manoeuvring rocker 66 is now acted upon in the opposite direction by the release arm 64. In this direction, the rocker 66 does not evade the release arm 64 but instead forces the release arm 64 to entrain the locking hook 58, which is brought out of its locking engagement with the locking element 56. Released in this way, the lever arm mechanism 44 is changed round and the hose 14 is decoupled from the carriage by the coupling means 38 being released from the coupling sleeve 36 in the manner previously described. The free end of the hose 14 thus drops under its own weight to the floor since the drum 22, by means of the electromagnetic coupling, is uncoupled from the gear 20 and the motor 18 when the motor is not activated, and the hose is connected to the end of the exhaust pipe of the motor vehicle 5. To ensure that the hose 14 is able to withstand tensile load, it is reinforced on the outside or inside in a known manner or is provided, for example, with a steel cable on the inside.

When the carriage 2, drawn by the vehicle 5, approaches the end position 6, the conventional coupling-members of the hose 14, which are operated by compressed air, are detached from the exhaust pipe of the vehicle 5 by means of the fact that (FIG. 3) the valve 34 is manoeuvred by the cam 33 a short distance before the carriage manoeuvres the second limit switch 32 which, with a certain delay, activates the motor and the electromagnetic coupling so that the drum 22 begins to wind up the cable 24 via the gear mechanism 20. The fact that the winding-up of the cable is somewhat delayed ensures that when the hose is detached from the vehicle's exhaust pipe, the free end of the hose 14 (FIG. 4) drops to the floor before hoisting begins. As soon as the cable 24 is taut, hoisting of the hose begins and at the same time the carriage 2, on account of the inertia of the hose and a certain friction in the system, begins to move from the end position towards the start position 4.

For reasons of safety, among others, it is advantageous for the hose to be anchored in its rest position before the carriage moves towards its start position. The lever arm mechanism 44 in this position (FIG. 7) is therefore changed round so that the catch member 50 abuts against the stop shoulder 62 and the movement of the carriage 2 is stopped. The winch 16 continues to wind up the cable 24, resulting in the coupling means 38 being pressed via the cable 24 into locking engagement with the coupling sleeve 36. The tensile stress in the cable 24 is then transmitted via the coupling sleeve and the spacing member 52 to the lever arm mechanism 44, which is changed round to the position shown in FIG. 6. In this position, the catch member 50 is freed from the stop shoulder 62 and the carriage 2 is able to begin its movement towards the start position 4. The carriage 2 is thus winched home to the start position by means of the cable 24, with the hose 14 anchored in its rest position via the coupling device 35. Immediately before the carriage 2 reaches the start position 4, its frame activates the first limit switch 30, which cuts out the motor 18, and the release arm 64 causes the rocker 66 to move aside to its position shown in FIG. 1. The carriage is now parked in its start position 4 and is ready to be used again.

An advantageous embodiment of the lever arm mechanism 44 is achieved by designing it as a cradle with two parallel levers, each comprising two arms, connected by means of a spacing member (FIG. 5) in the form of a bracket 52. The decoupling member is then expediently designed as a larger bracket 54 which encloses the bracket 52 and which is no anchored on both sides of the frame of the carriage 2. The second lever arms 48 can be correspondingly connected by means of the locking element 56. A stable and operationally reliable lever arm mechanism 44 is obtained in this way.

Alternatively, the locking element 56, the locking hook 58, the release arm 64 and the manoeuvring rocker 66 can be supplemented by or replaced with a rocker arm (not shown) mounted on the carriage 2. The rocker arm is arranged to act, when manoeuvred, on the coupling device 35 in such a way as to release the coupling means 38. When the carriage 2 is situated in the start position 4, a manoeuvring mechanism (not shown) mounted on the extractor channel 1 can be made to act on the rocker arm by means of a separately suspended cable (not shown). In this position, it is therefore possible to release the coupling means 38 from locking engagement with the coupling sleeve 36 by pulling on the suspended cable.

It is also possible to achieve a further improved function, with smooth and easy movement when the hose 14 is released by the coupling device 35, by means of providing the cable drum 20 with an adjustable cable brake (not shown). The cable brake is preferably designed as a two-stage brake. The first stage is, for example, a pneumatically or hydraulically applied brake which can be regulated via a regulator. The second stage is, for example, a friction brake which can be set to a predetermined application force via a spring prestressed by a nut.

When the carriage 2 is located in its start position 4, a brake cylinder is activated by means of pressure supply and the brake is applied relatively firmly. This means that the hose 14 is moved down towards the floor, hanging on the cable 24, in a controlled, smooth and easy movement. When the carriage 2 is driven away from the start position 4 by means of the vehicle, the brake cylinder is de-activated and the braking force falls to a lower value, defined by the spring prestressed by the nut.

In this way it is possible to obtain a relatively firm application of the cable brake when the carriage 2 is located in its start position 4, and at the same time the cable brake is applied relatively lightly when the carriage is being driven away from the start position, drawn by the vehicle.

Both in the start position 4 and in the end position 6, the extractor channel 1 is expediently provided with resilient buffer arrangements of a conventional type which softly brake the carriage 2 as it approaches each position.

Instead of the cooperation between the catch member 50, and the stop shoulder 62, the catch device can also be designed with friction members, for example brake linings or the like, which act between the carriage 2 and the extractor channel 1. Instead of using the coupling sleeve 36 and the coupling means 38 as in the described method,-the function of the coupling device 35 can also be achieved, for example, by using a ring which, by means of guide members, can be brought into engagement with a openable hook or the like.

What is claimed is:

1. Extractor system, especially for exhaust gases from a motor vehicle (5), comprising an extractor channel (1) with a carriage (2), which is arranged to connect the extractor channel (1) to a hose (14) and which is guided along the extractor channel and drawn by the vehicle from a start position (4) to an end position (6), which hose (14) can be connected to the vehicle's exhaust pipe and can be detached therefrom at the end position (6), at which the carriage (2) can be retained by means of a catch device (50, 62), which can be released by a drive device (16), which is additionally arranged to manoeuvre the hose to a rest position in connection with the carriage (2), which, with the catch device (50, 62) released, can be returned to the start position (4) via a flexible element (24) connected to the drive device (16), characterized in that the drive device (16) has a winch (18, 20, 22) located at the start position (4) for winding up the element (24), which extends through recesses (26, 28) in the carriage (2) to an attachment point (29) on a predetermined part of the hose (14), which via the element (24) can be drawn up to the rest position and can be anchored to the carriage (2) by means of a coupling device (35) acting on the catch device (50, 62).

2. Extractor system according to claim 1, characterized in that the catch device (50, 62) is connected to the coupling device (35) by means of a lever arm mechanism (44).

3. Extractor system according to claim 2, characterized in that the lever arm mechanism (44) has a first lever arm (43) which acts on the coupling device (35), and a second lever arm (48) which is provided with a catch member (50) forming part of the catch device.

4. Extractor system according to claim 3, characterized in that the catch device (50) is in a catch position relative to a stop shoulder (62) arranged at the end position of the extractor channel (1), at the same time as the hose (14) is released from the carriage (2) by means of the coupling device (35).

5. Extractor system according to claim 3, characterized in that the catch member (50) is in a release position relative to a stop shoulder (62) arranged at the end position of the extractor channel (1), at the same time as the hose (14) is securely anchored in its rest position by means of the coupling device (35).

6. Extractor system according to claim 1, characterized in that the coupling device (35) comprises a female part (36) secured to the first lever arm (43), and a male part (38) secured to the element (24).

7. Extractor system according to claim 1, characterized in that when the hose (14) is securely anchored in its rest position, the lever arm mechanism (44) is locked by means of a locking element (56) connected to the second lever arm (48) and by means of a locking hook (58) connected to the carriage.

8. Extractor system according to claim 7, characterized in that the locking hook (58) is pressed by means of a spring arrangement (61) into locking engagement with the locking element (56) and can be manoeuvred out of its locking engagement by means of a release arm (64).

9. Extractor system according to claim 1, characterized in that the coupling sleeve (36) can be manoeuvred by means of a decoupling member (54) into and out of locking engagement with the coupling means (38) depending on the status of the lever arm mechanism (44).

10. Extractor system according to claim 1, characterized in that the length of the element (24) at least corresponds to the distance from the winch (16) through the carriage (2), when the latter is in its end position (6), and to the predetermined position on the floor of the extractor system at the end position (6).

11. Extractor system according to claim 1, characterized in that the coupling device (35) is arranged to retain the hose (14) in, or release it from, its rest position, as a consequence of the interaction between a release arm (64) connected to the locking hook (58) and a manoeuvring rocker (66) which is mounted on the extractor channel (1) at the start position (3) of the carriage (2).

12. Extractor system according to claim 1, characterized in that the coupling device (35) is arranged to retain the hose (14) in, or release it from, its rest position, as a consequence of the interaction between a rocker arm mounted on the carriage (2) and a manoeuvring mechanism which is mounted on the extractor channel (1) at the start position (3) of the carriage (2).

13. Extractor system according to claim 12, characterized in that the manoeuvring mechanism is arranged, by means of a cable, to release the coupling means (38) from locking, engagement with the sleeve (36).

14. Extractor system according to claim 1, characterized in that the cable drum (20) is provided with cable brake which comprises a first stage that can be applied by a brake cylinder, and a second stage including a friction brake that can be adjusted to predetermined application by a spring which is pre-stressed by a nut.

* * * * *